United States Patent [19]

Applegate et al.

[11] Patent Number: 4,503,965

[45] Date of Patent: Mar. 12, 1985

[54] APPARATUS FOR HANDLING ROD-LIKE ARTICLES

[75] Inventors: Barry G. Applegate; Stanley V. Starkey, both of London, England

[73] Assignee: Molins Limited, London, England

[21] Appl. No.: 462,013

[22] Filed: Jan. 28, 1983

Related U.S. Application Data

[62] Division of Ser. No. 195,950, Oct. 10, 1980, Pat. No. 4,423,996.

[30] Foreign Application Priority Data

Oct. 10, 1979 [GB] United Kingdom ..... 7935122

[51] Int. Cl.[3] ..... B65G 37/00

[52] U.S. Cl. ..... 198/347; 198/631

[58] Field of Search ..... 198/347, 631, 369

[56] References Cited

U.S. PATENT DOCUMENTS 1,521,820 1/1925 Lloyd ..... 198/631 X 1,566,701 12/1925 Schumacher ..... 198/631 X 4,365,703 12/1982 Hinchcliffe et al. ..... 198/347

4,366,895 1/1983 Bennett et al. ..... 198/347

*Primary Examiner*—Robert J. Spar

*Assistant Examiner*—Jonathan D. Holmes

*Attorney, Agent, or Firm*—Antonelli, Terry & Wands

[57] ABSTRACT

Apparatus for transferring cigarettes or the like at a transfer station between a mass flow conveyor system including a reversible transfer conveyor and a movable trolley having vertical compartments for holding batches of cigarettes, comprises structure for separating articles in the trolley from articles on the transfer conveyor including movable bands defining spaced outlets and an apertured plate, which bands and plate are sequentially moved to close or open the outlets. Two compartments are normally filled or emptied simultaneously. The cigarettes are supported in the compartments by movable captive platforms which are operated on by a hoist associated with the transfer station.

17 Claims, 4 Drawing Figures

APPARATUS FOR HANDLING ROD-LIKE ARTICLES

This application is a division of U.S. Application Ser. No. 195,950, filed Oct. 10, 1980, now U.S. Pat. No. 4,423,996.

This invention relates to apparatus for handling rod-like articles, and in particular to a conveyor system for moving articles such as cigarettes or cigarette filter rods in stack formation in a direction transverse to the lengths of the articles.

In the manufacture of filter cigarettes it is known to feed filter cigarettes in stack formation from a filter cigarette assembling machine to a filter cigarette packing machine. It is convenient to provide a buffer reservoir connected to a conveyor linking such an assembling machine to a packing machine so that differences between the supply from the assembling machine and the demand of the packing machine can be equalized by supply from or to the buffer reservoir. One system in which the reservoir comprises trolleys carrying trays which may be loaded with batches of cigarettes is disclosed in British Patent Specification No. 1,404,141. Another system, which also uses trolleys, is described in our British Patent Specification No. 2,035,248. The present invention is concerned with a conveyor system which is particularly, but not exclusively, usable in a similar manner to provide a buffer reservoir for rod-like articles.

According to the present invention a conveyor system for rod-like articles comprises conveyor means for conveying rod-like articles in a direction transverse to their lengths, means for transferring articles to or from the conveyor means at different locations, said transferring means including means defining a path for articles moving in stack formation in a direction transverse to their lengths, and switching means for closing a path at one location and opening a path at another location to switch transfer of articles from one location to another location.

Means may be provided for positioning reservoir means adjacent each of said locations for transfer of articles to or from the conveyor means. The system may additionally include means for moving reservoir means past said locations, preferably for transfer of articles to or from said locations in sequence. The reservoir means may comprise compartments of a mobile container. The compartments may comprise substantially vertical channels.

The switching means may comprise means for moving the path defining means relative to the conveyor means, preferably in a direction generally parallel to a conveyance direction of said conveyor means. The path defining means may define a gap in the conveyor means and the switching means may comprise means for moving the position of the gap. Preferably the gap is maintained of substantially constant width as it is moved. The switching means may include subsidiary gate means for blocking said gap and means for moving said gate means to unblock said gap.

The conveyor means may comprise endless band conveyors and the gap may be defined between spaced opposed bands. Preferably at least one of said bands is drivable at the conveyance speed of the conveyor means. Preferably means are provided for controlling movement of the bands during movement of the gap such that the advancing end of a band tends to move articles out of its path. The arrangement may, therefore, in principle, be similar to that described in British Patent Specification No. 2,017,618, the disclosure of which is hereby incorporated herein in full.

The gate means may be movable in a direction parallel to the movement of the gap. The gate means may, for example, comprise a plate provided with an aperture having a length corresponding to the width of the gap. The system may be operated so that said gap and said gate means are operable independently. In this case the gap and the gate means may be moved sequentially so that initial movement of the gap effectively closes said gap by moving it to a position blocked by said gate means; subsequently the gate means may be moved to re-open the gap at a different location.

In a preferred arrangement the conveyor means comprises a horizontal conveyor with two or more gaps of equal width, spaced apart by a distance corresponding to their width. The gaps may then be reciprocated to communicate with a continuous line of compartments each having a dimension corresponding to said width and positioned beneath said conveyor means. A plate provided with a number of appropriately spaced apertures to cooperate with said gaps is preferably provided beneath said horizontal conveyor means. Rod-like articles may be supplied to (or received from) said compartments simultaneously through two or more gaps. When the compartments have been filled (or emptied) the positions of the gaps are shifted to cover the adjacent alternate compartments. The apertured plate remains in place, so for a short period there is no communication between the compartments and the conveyor means. Subsequently the plate is shifted, normally in the same direction as the gaps, to allow filling (or emptying) of the alternate compartments.

The compartments may form one row of parallel compartments in a trolley which may be moved in a direction transverse to said conveyor means to bring successive rows of compartments into position beneath said conveyor means. The conveyor system may, therefore, include means defining a path for a movable container having at least one compartment for a batch of rod-like articles in stack formation, the container being movable on said path to position a compartment at a station to receive articles from or deliver articles to said conveyor means through a gap, and means for conveying articles at said station between said gap and said compartment in a direction transverse to the lengths of the articles. The means for moving articles at the station may be arranged to move the articles within the compartments. The provision of two or more gaps serving two or more spaced compartments simultaneously, together with means for moving the gaps in a conveyance direction of the conveyor means and gate means for said gaps, has the significant advantage when transferring articles to or from a container including the compartments that it is possible to switch the flow of articles from one compartment to another compartment (or, more generally between alternating sets of compartments) very rapidly by sequential movement of the gap (or gaps) and the associated gate means. This may mean that a smaller reservoir, or even no reservoir, is required to accommodate this flow of articles whilst changing compartments.

The invention will be further described, by way of example only, with reference to the accompanying diagrammatic drawings, in which.

Figure 1:
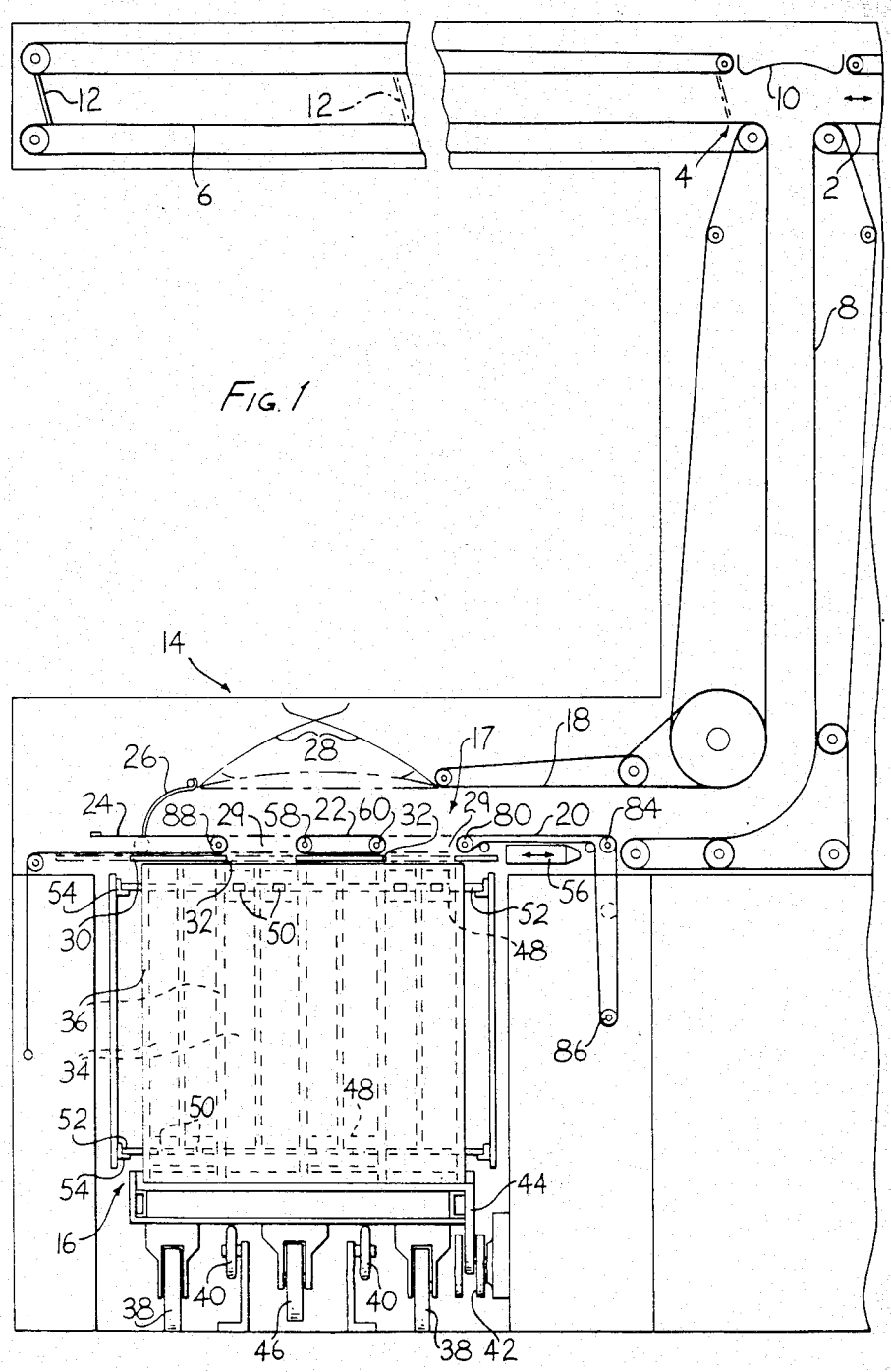
FIG. 1 is a side view of a conveyor system for rod-like articles.

The conveyor system includes a reversible conveyor 2 for moving rod-like articles in stack formation in a direction transverse to their lengths towards or away from a junction 4. The conveyor 2 may lead to and from part of a conveyor system linking one or more article producing machines to one or more article receiving machines. For example, where the rod-like articles are cigarettes the conveyor system may be arranged between cigarette making machines and cigarette packing machines.

A reversible variable capacity reservoir 6 is connected to the junction 4 opposite the conveyor 2. A reversible elevator 8 extends substantially vertically downwards from the junction 4. A level sensor 10 is arranged above the junction 4 and controls the speed of one or more of the conveyors 2, 6, and 8 in accordance with the desired flow of articles to or from the junction 4. A way in which this may be achieved is described in more detail in British Patent Specification No. 1,299,174. The reservoir 6 includes an end wall 12, the position of which may be used to control the supply of articles to the junction 4 in accordance with the disclosure of said Specification No. 1,299,174.

The elevator 8, which may be substantially as disclosed in British Patent Specification No. 1,453,191, leads to a transfer unit 14, at which articles are supplied to or received from trolleys 16. The trolleys 16, in association with the transfer unit 14, can provide a buffer reservoir facility of practically unlimited capacity for the conveyor system including the conveyor 2.

The transfer unit 14 includes a horizontal transfer conveyor 17 extending from the bottom of the elevator 8 and comprising an endless band upper conveyor 18 and endless band lower conveyors 20 and 22, all of which are drivable. There is also a further lower band 24, a curved end plate 26, and a small variable capacity reservoir defined by inter-linked pivoted arms 28.

The bands 20 and 22 and the bands 24 and 22 are spaced apart by the same distance and define gaps 29 through which articles may pass to or from the conveyor 17. Immediately beneath the bands 20, 22 and 24 is a movable plate 30 provided with apertures 32 which correspond in dimensions and spacing with the gaps 29 between the bands and, in the position shown in FIG. 1, are aligned with these gaps.

Figure 2:
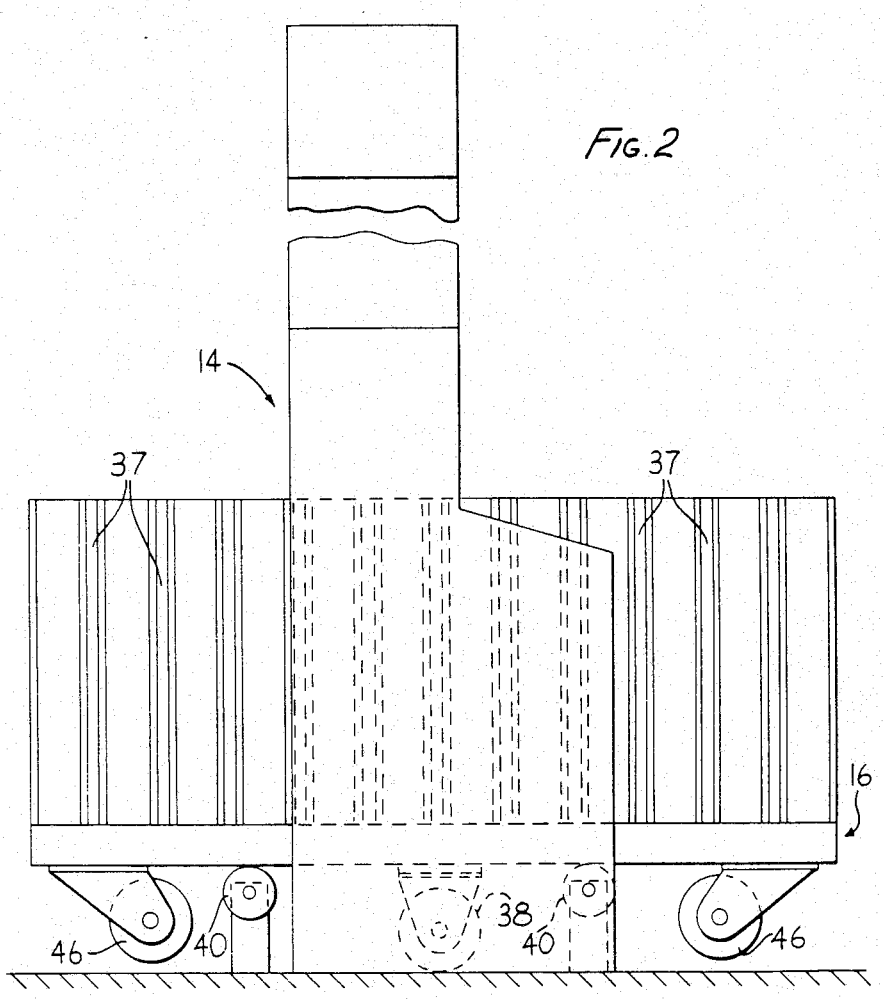
FIG. 2 is an end view of the conveyor system of FIG. 1.

The widths of the gaps 29 and of the apertures 32 correspond to the widths of vertical compartments 34 defined by partitions 36 in the trolley 16. Each trolley 16 contains twelve rows each of four compartments 34, the rows being separated by partitions 37 as shown in FIG. 2. Trolleys 16 are movable past the transfer unit 14 so that successive rows of four compartments 34 are positioned underneath the transfer conveyor 17. When in position for transfer of articles the trolley 16 rests on its own central wheels 38 and also on rollers 40 associated with the transfer unit 14. The trolley 16 is indexed to move successive rows of compartments 34 underneath the transfer conveyor 17 by means of a drive gear 42 associated with the transfer unit 14, which gear engages spaced slots in a flange 44 carried by the trolley. The arrangement may be similar to that disclosed in British Patent Specification No. 1,117,236 or 1,404,141. The trolley 16 carries single front and rear wheels 46 at a level higher than the wheels 38; this arrangement facilitates maneuverability of the trolley when being moved to or from the transfer unit 14.

Articles are passed from the transfer conveyor 17 simultaneously into two compartments 34 during loading, through the gaps 29 defined between bands 20 and 22 and 22 and 24 and through the apertures 32 in plate 30. For this purpose each compartment 34 is provided with a captive platform 48 which is vertically movable in the compartment. Each platform 48 is formed with lugs 50 which extend beyond the sides of the compartment 34 and are connected to a bar 52 which extends horizontally across the trolley 16 between each row of compartments 34, i.e. the bar 52 extends between separate walls comprising the partitions 37. The bars 52 for the platforms 48 in compartments 34 at the transfer unit 14 are engaged at each end by a vertically drivable lug 54 forming part of the transfer unit 14. The platforms 48 in alternate compartments 34 are each attached to a bar 52 engaged by a pair of lugs 54, so that there are two bars for each row of compartments and the transfer unit has two pairs of lugs. The platforms 48 are therefore raised or lowered by the lugs 54 in pairs.

Assuming that the trolley 16 shown in FIG. 1 is being loaded with articles the platforms 48 in the two compartments 34 beneath the gaps 29 between the bands 20, 22 and 24 are progressively lowered at a speed which is matched to the speed at which articles are being delivered down the elevator 8. Fine control of the speed at which the platforms 48 are lowered may be achieved by sensors associated with the pivoted arms 28 above the transfer conveyor 17. During loading the bands 20 and 22 are driven in the direction of the flow of articles; the band 24 is not driven and normally remains stationary.

In a loading operation the compartments 34 furthest along the transfer conveyor section 17 are normally loaded first. Therefore, when the second set of compartments 34 (i.e. those being filled in FIG. 1) have been filled, so that the platforms 48 are at the bottoms of the compartments, the trolley 16 is indexed by the drive gear 42 to bring another row of compartments 34 underneath the transfer conveyor 17. Before this can happen the supply of articles from the transfer conveyor 17 is cut off by advancing the bands 20 and 22 to the left, as viewed in FIG. 1, to cover the apertures 32 in the plate 30. At the same time the band 24 is retracted by the same amount, so that the gaps 29 between the bands 20, 22 and 24 are shifted to the left and are positioned over the first and third compartments of the row (as numbered from the left in FIG. 1). The band 24 is retracted by moving its end pulley to the position indicated in dotted outline in FIG. 1. The arrangement and mechanism for moving the band 24 may be substantially as disclosed in British Patent Specification No. 2,017,618, to which reference is directed for further details.

Drive to the bands 20 and 22 is stopped during their movement across the top of the compartments 34 and, as will be explained below, the upper surface of each band is arranged to remain stationary relative to the articles on the transfer conveyor 17 so that the advancing parts of each band unroll beneath the articles; as explained in said Specification No. 2,017,618 this helps to minimize disturbance of and possible damage to the articles.

After the bands have moved, the first and third compartments 34 in the row beneath the transfer conveyor 17 are covered by blank parts of the apertures plate 30 whilst the second and fourth compartments are covered by the bands 22 and 20 respectively. Since the transfer conveyor 17 is thus closed the trolley 16 can be indexed to bring empty compartments 34 into position beneath the transfer conveyor. While the trolley 16 is being indexed and the transfer conveyor 17 is closed the reservoir 6 accepts the full output of the conveyor 2. It is arranged that the articles received by the reservoir 6 during this period are exhausted from the reservoir (and therefore pass down the elevator 8) during loading of the next row of compartments 34, so that the effective capacity of the reservoir 6 is not diminished by each row change.

During a row change the lugs 54 become disengaged from the bars 52 of the filled row of compartments 34 and are returned to the top of their travel for engagement with the bars 52 of the new row of empty compartments. Normally, empty compartments have their platforms 48 at the top, e.g. held lightly by spring clips which are disengaged by movement of the row beneath the transfer conveyor 17 or by the lugs 54. Alternatively the lugs 54 could remain at their lower level until indexing of the trolley 16 has taken place and then be moved to their uppermost position carrying with them the platforms 48.

Loading of the first and third compartments 34 is initiated by movement of the plate 30 so that the apertures 32 are aligned with the gaps 29 between the bands 20, 22 and 24. The platforms 48 are then lowered in accordance with feed of articles along the conveyor section 17, as before. When the first and third compartments are filled the bands 20, 22 and 24 are all moved to the right, i.e. into the position shown in FIG. 1, to close the first and third compartments, and then the plate 30 is also moved to the right to allow loading of the second and fourth compartments 34 to begin.

Unloading, when required by the conveyor system including conveyor 2, is a reversal of loading. The bands 20, 22 and 24 are used to confine the streams transferred from one pair of compartments followed by movement of the apertured plate 30 to allow articles to pass from the other pair of compartments. Thus, during unloading the second and fourth compartments are normally unloaded first and, from the position shown in FIG. 1, the bands 20, 22 and 24 are moved to the left, followed by the plate 30, to allow unloading of the first and third compartments 34. When these, too, are empty the bands 20, 22 and 24 are moved to the right whilst the plate 30 remains in position, to shut off the transfer conveyor 17 and allow indexing of the trolley 16. The bands 20, 22 and 24 are then in position to allow unloading of the next row of compartments starting with the second and fourth compartments.

Reversal between loading and unloading can take place, in theory, at any time but for ease of control it may be preferable to arrange for such reversal only to take place after loading (or unloading) of a complete pair of compartments 34 or a complete row of compartments. It will be appreciated that the trolley 16 is indexed in opposite directions depending on whether the transfer unit 14 is operating to load or unload the trolley. Thus, for example, the rows of compartments 34 to the right of the transfer unit, as viewed in FIG. 2, may be full and those to the left may be empty.

Figure 3:
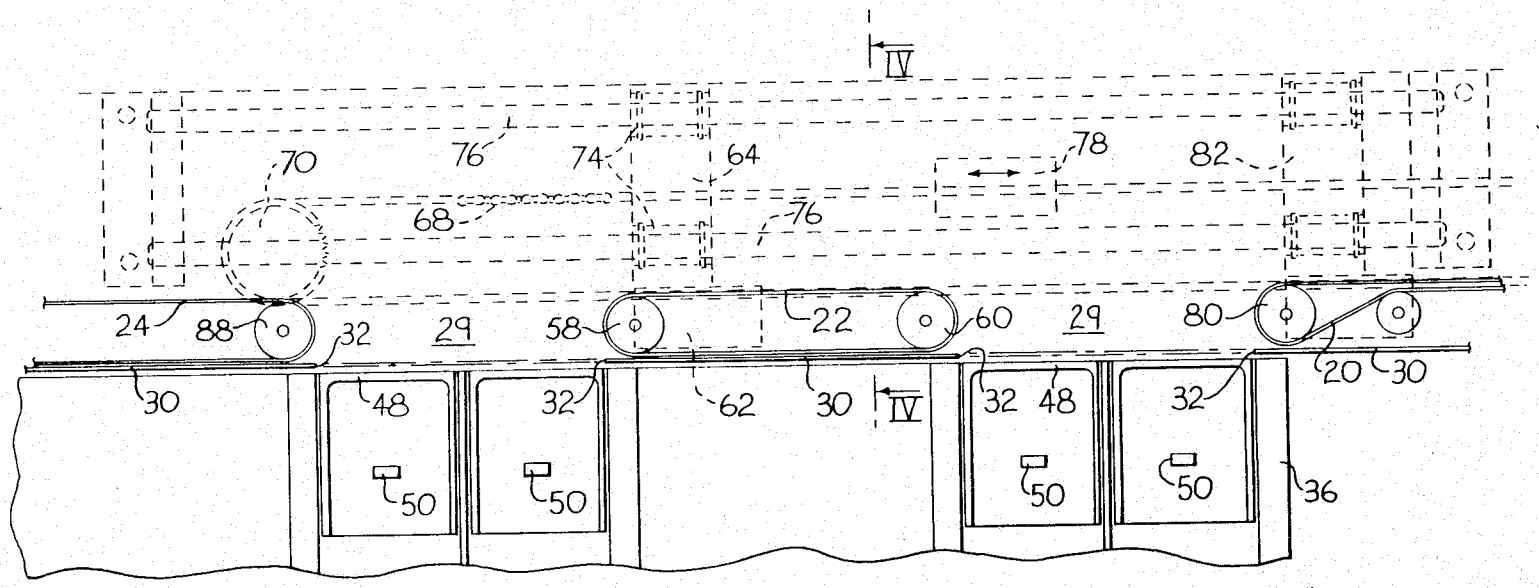
FIG. 3 is an enlarged view of part of the conveyor system of FIG. 1.
Figure 4:
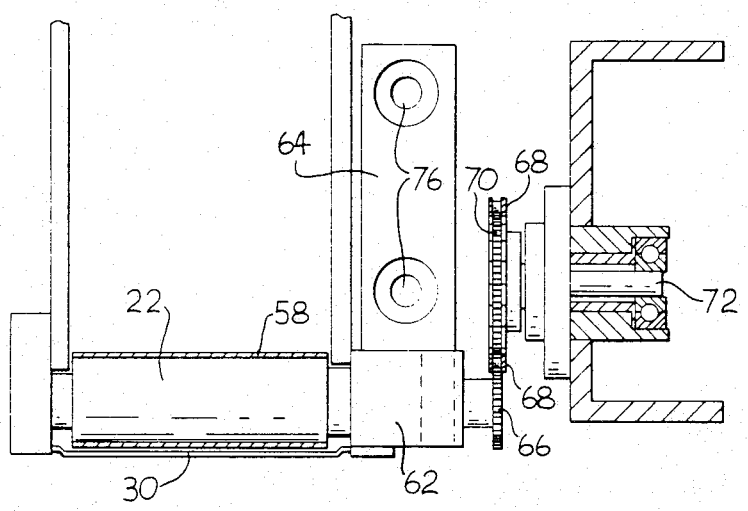
FIG. 4 is a view on the line IV—IV in FIG. 3.

The way in which the bands 20, 22 and 24 are moved to move the gaps 29 can be understood by reference to FIGS. 3 and 4. Movement of the two driven bands 20, 22 is similar and will be explained by reference to movement of the band 22. The band 22 passes round spaced pulleys 58, 60 which are rotatably supported on a member 62 carried by a slide 64. The pulley 58 carries a sprocket 66 which is in engagement with a chain 68 driven through a sprocket 70 and drive shaft 72. The slide 64 is mounted by linear bearings 74 on parallel rods 76 forming a guide for the slide 64 and is moved on the rods or held stationary by means indicated diagrammatically at 78. The means 78 may, for example, comprise an air cylinder.

The pulley 58 may be rotated to move the band 22 in either direction (depending on whether loading or unloading is taking place) by driving the chain 68 in the appropriate direction. In this case the slide 64 is held stationary by the means 78. When it is required to advance the band 22 to the right as viewed in FIG. 3, the chain 68 is stopped and the slide 64 advanced to the right. The pulleys 58 and 60 are thus also moved to the right and the sprocket 66 runs along the stationary chain 68 which causes anti-clockwise movement of the pulley 58 and band 22 as the band advances over the compartment to the right. This is the "unrolling" movement required for least damage to the articles during stream separation.

The band 20 is carried by a leading pulley 80 mounted on a slide 82 and is rotated and moved in exactly the same way as the band 22. The only difference is that as the band 20 is not required to open a gap at its end remote from the band 22 it passes around a fixed roller 84 (FIG. 1) and an additional movable roller 86 (FIG. 1) is provided to accommodate the movement of the band 20 as the slide 82 is advanced or retracted.

Since the band 24 is not driven there is no need for it to cooperate with the chain 68. Accordingly, it is advanced and retracted by movement of its leading pulley 88, one end of the band 24 being fixed and the other end under tension, as indicated in FIG. 1. This arrangement is substantially as disclosed in British Patent Specification No. 2,007,964.

We claim:

1. A conveyor system for rod-like articles, comprising means defining a path for rod-like articles in stack formation, comprising conveying means including an endless band having a conveying surface for moving articles on said path, first drive means for advancing said conveying surface to move articles on said path, and second drive m ans for reciprocating said endless band bodily along said path, said first and second drive means being coupled to said conveying means so that the endless band is driven to maintain said conveyor surface stationary relative to said path during said bodily movement by said second drive means in each direction of said reciprocation along said path when said first drive means is inactive, whereby reciprocation of said endless band may be effected without disturbance to articles in contact with said conveying surface.

2. A conveyor system as claimed in claim 1 said conveying means further including spaced pulleys around which said endless band extends, said first drive means being connected to at least one of said pulleys.

3. A conveyor system as claimed in claim 2, wherein said first drive means includes first and second interengaging drive elements, said first drive element extending in a direction substantially parallel to said path and said second drive element being drivingly connected to at least one pulley of said conveying means, and means for moving said first drive element to cause said conveying surface to advance along said path and for holding said first drive element stationary during operation of the second drive means.

4. A conveyor system as claimed in claim 3, wherein said first drive element comprises a chain and said second drive element comprises a sprocket.

5. A conveyor system as claimed in claim 2, said conveying means including a carrier on which said pulleys are mounted and a guide extending substantially parallel to said path on which said carrier is movable, said second drive means including means coupled to said carrier for moving said carrier along said guide.

6. A conveyor system as claimed in claim 1, including means defining a subsidiary path joining said path, wherein said second drive means is arranged to reciprocate said endless band between a position at which articles may pass between said path and said subsidiary path and a position at which said endless band blocks passage of articles between said subsidiary path and said path.

7. A conveyor system for rod-like articles, comprising means defining first and second paths for rod-like articles in stack formation and a junction between said paths, support means in the form of an endless band and spaced means around which said band passes, said band having a surface extending substantinlly parallel to said first path, means for conjointly moving said support means so that said endless band is moved bodily in a direction substantially parallel to said surface and so that said spaced means remains at substantially constant spacing during said movement, said moving means including means for moving said support means between a first position wherein passage between said first and second paths is unobstructed and a second position wherein said surface blocks passage between said first and second paths in such a way that said surface remains stationary relative to said first path during such movement of the support means in each direction between said first and second positions, whereby movement of said support means between said first and second positions may be effected without disturbance to articles in contact with said surface.

8. A conveyor system as claimed in claim 7, wherein said surface extends along and maintains a substantially-constant length along said first path.

9. A conveyor system as claimed in claim 7, wherein said surface is rotatable in a conveyance direction of said first path.

10. A conveyor system as claimed in claim 9, including means for moving said surface in said direction relative to said support means and for holding said surface stationary relative to said path.

11. A conveyor system as claimed in claim 7, wherein said first and second paths are disposed at 90° at said junction.

12. A conveyor system as claimed in claim 7, wherein said junction is a T-junction and said first path defining means includes means for conveying articles along said first path towards and past said junction.

13. A conveyor system as claimed in claim 7, including means for moving said surface to convey articles on said first path when said endless band is in said second position.

14. A conveyor system as claimed in claim 7, including means for moving said surface to convey articles on said first path when said endless band is in said first position.

15. A conveyor system for rod-like articles, comprising means defining a path for rod-like articles in stack formation, means defining a discontinuity in said path, means including an endless band having a conveying surface for moving articles on said path, first drive means for moving said conveying surface to convey articles along said path, reversible second drive means for moving said endless band bodily along said path between a first position in which the band bridges said discontinuity and a second position in which it is substantially clear of said discontinuity, and means for maintaining said conveying surface stationary relative to said path during said bodily movement in each direction of movement between said first and second positions when said first drive means in inactive, whereby bodily movement of said endless band between said first and second positions may be effected without disturbance to articles in contact with said conveying surface.

16. A conveyor system as claimed in claim 15, wherein the first drive means is reversible so that the conveying surface may be selectively moved to convey articles in opposite directions along said path.

17. A conveyor system as claimed in claim 15, wherein said first drive means is operable to move said conveying surface only when said second drive means is stationary.

* * * * *